United States Patent [19]

Raquet

[11] Patent Number: 4,481,638

[45] Date of Patent: Nov. 6, 1984

[54] ELECTRIC ARC FURNACE

[75] Inventor: Erwin Raquet, Witten, Fed. Rep. of Germany

[73] Assignee: Krupp Stahl AG, Bochum, Fed. Rep. of Germany

[21] Appl. No.: 357,823

[22] Filed: Mar. 12, 1982

[51] Int. Cl.[3] ..... H05B 7/10

[52] U.S. Cl. ..... 373/98; 188/378

[58] Field of Search ..... 188/378, 379, 380; 373/98, 99, 94, 105; 174/42; 267/140.1

[56] References Cited

U.S. PATENT DOCUMENTS 4,351,515 9/1982 Yoshida ..... 188/380 X

FOREIGN PATENT DOCUMENTS 2028619 3/1980 United Kingdom ..... 373/98

*Primary Examiner*—Roy N. Envall, Jr.

*Attorney, Agent, or Firm*—McAulay, Fields, Fisher, Goldstein & Nissen

[57] ABSTRACT

The invention relates to an electric arc furnace having three electrodes arranged in a triangle and wherein the electrodes are held by parallel support arms for reducing electrode breakages. At least the support arm of the electrode most susceptible to breakage is provided with a resonance absorber whose natural frequency is tuned to the frequency of the support arm/electrode system for rocking vibrations in the plane of the support arm-/electrode.

17 Claims, 4 Drawing Figures

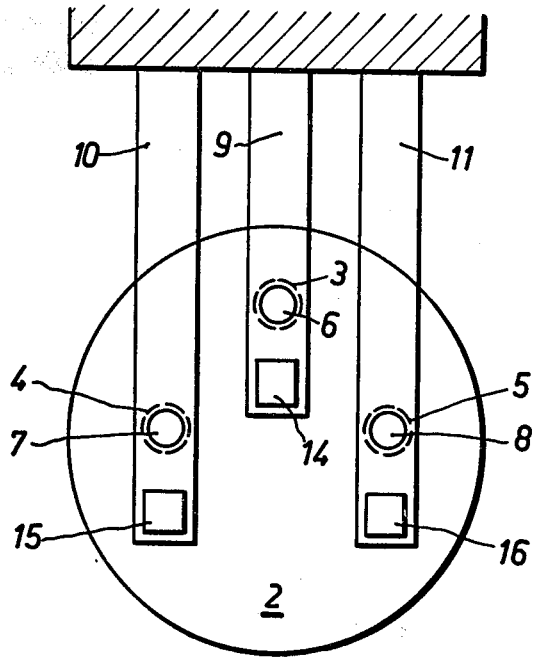
Fig. 1
Fig. 2
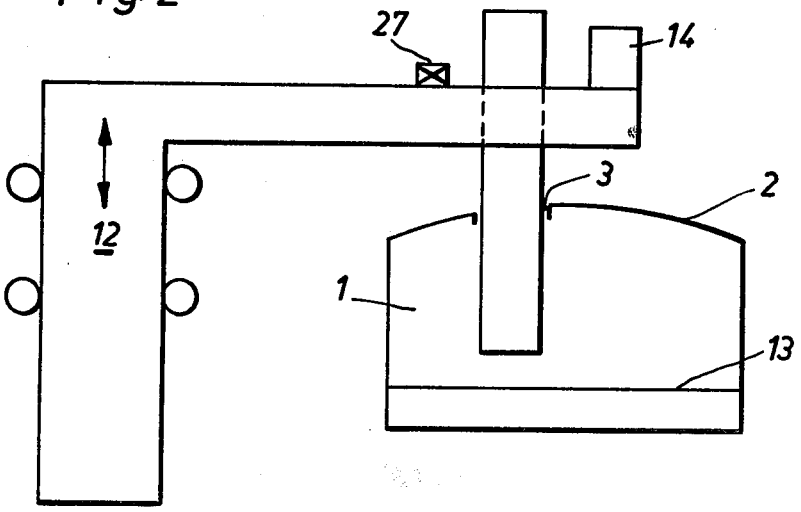

ELECTRIC ARC FURNACE

BACKGROUND OF THE INVENTION

Electric arc furnaces for melting metal especially steel generally have three vertical electrodes arranged in a triangle and held by horizental parallel support arms and are operated as three-phase furnaces. Only for special purposes, for example in the pre-melting of slag in the slag reaction method are they provided with one electrode and operated as single-phase furnaces.

Furnaces of this type for a long time have suffered from the well known problem that the electrodes break off from the support arm at the point where they are clamped in. In a furnace equipped with three electrodes the breakage rate amounted to five to ten per month. After changing over to higher melt output rates (heavier current,) the breakage rate increased to 30 to 40 per month. The central electrode was particularly vulnerable, i.e. when the electrodes were arranged in a triangle and when the electrodes were held by parallel support arms and the electrode was fixed to the shorter central support arm.

A possible solution for reducing the breakage rate by stiffening the support construction becomes problematic because of the increase in the mass associated therewith, since bigger masses also require a stronger drive for lifting and lowering the support arm construction. A reduction in the breakage rate by improving the mechanical properties of the electrodes therefore results in an increase in cost.

Another proposal for reducing the breakage rate of the electrodes consists in a damping device positioned on the support arm of the respective electrode. The damping device includes a neutral mass, which is coupled to the support arm by a spring and which can move normally in respect to the common plane of the electrode and the support arm under the oscillations of the arm. The movement of the mass is damped by damping means, for instance by a hydraulic fluid in which the mass is embedded. The basic idea of this solution is to absorb the oscillations in the damping material where the mechanical energy is converted into heat. It has been found that this method is not effective in protecting the electrodes against breakage as disclosed in unexamined German patent application No. 2837741.

It is the object of the invention to provide an electric arc furnace in which the danger of breakage of the electrodes is reduced in comparison with those of conventional arc furnaces.

SUMMARY OF THE INVENTION

This object is achieved according to the invention in that at least on the support arm of the electrode which is most susceptible to breakage there is arranged a vibration remover which has its natural frequency tuned to the natural frequency of the vibration system of the support arm/electrode for the rocking vibration in the plane of the support arm/electrode.

In the case of electrodes arranged three to a triangle held variously by parallel support arms, the outermost of which being of the same length and the central support being of a different length, the vibration remover is arranged on the centre support arm.

The invention is based on the discovery that the electrode and the support arm vibrate as a system in such a way that rocking vibrations of the support arm of the electrode appear in the plane of the support arm/electrode. These vibrations are regenerated by the arc furnace vibration (so called "flicker" vibrations). The electrode thus acts like a lever arm on the support arm and is subjected to the strongest flexing action at the point where it is clamped to the support arm. By attaching a vibration remover to the support arm the natural vibrations are damped in such a way that counter forces of the same frequency are created in the vibration remover which compensate the forces of the system of the support arm/electrode whereby the vibration amplitude is considerably reduced. The use of the vibration remover makes it superfluous for the construction and the drive of the support arm construction to be strengthened or that the electrodes be made from a mechanically more superior material. The reduction in the vibration amplitude of the system support arm/electrode also leads to a reduced load on the drive and the guidance of the support arm structure, as well as the support arm structure itself.

The breakage rate can be substantially reduced merely by arranging a vibration remover on the central support arm. The electrode of the center support arm is particularly susceptible because the vibrations of the electrode are situated in the plane of the electrode and support arm, in other words, in a plane in which the structure is relatively strong, while the vibrations of whose outer electrode, the vibration plane does not coincide with the plane of the electrodes and the support arm, can partly be absorbed by the torsion of the support arm.

Suitable vibration removers may be passive and active vibration removers, but a combination of passive and active vibration removers may also be provided.

A passive vibration remover, for example, comprises a spring, a damper arranged parallel therewith and a neutral mass supported by the spring and the damper. The damper is not necessary for creating counterforces but it broadens the band width of the resonance frequency to which the oscillation remover is tuned.

A particularly compact construction of a vibration remover is characterised in that the neutral mass has a lug housed in a fixed sleeve on the outside of which is arranged a helical spring. The neutral mass may be cup-shaped and surrounds the spring.

Preferably, the neutral mass of the vibration remover is provided with a vibration pick-up which on exceeding a predetermined amplitude value of the vibrations of the neutral mass feeds to the current supply a switch-off signal for the electrode or electrodes. The cutting off of the current supply additionally helps to counteract the setting up of vibrations.

According to one embodiment of the invention in an active vibration remover the neutral mass forms the armature of an electro-magnet whose winding is induced in response to the control signal of a vibration pick-up for the rocking vibration of the vibration system support arm/electrode in the plane of the support arm/electrode in such a way that the vibration remover, which has thus been excited to vibrate in the plane of the support arm/electrode, builds up forces in the support arm which act against the excitation forces of the arc acting on the lower end of the electrode. In this case the vibration pick-up may be arranged on the support arm, especially on the neutral mass. A vibration remover of this type enables the damping of the vibrations of the vibration system over a wide range of frequencies and more effectively than the passive vibration remover. In an active vibration remover, as a rule, the features of the passive vibration remover are also realised in order to keep the magnetic forces as small as possible. As has already been stated above, on exceeding a specific amplitude value of the vibrations by means of a vibration remover the supply of current to one or more of the electrodes can be interrupted for one or more phases of current.

DESCRIPTION OF THE DRAWINGS

The invention is now explained in more detail with reference to the accompanying drawing wherein:

FIG. 1 shows an arc furnace schematically represented in plan view,

FIG. 2 shows the arc furnace according to FIG. 1, with the central electrode shown schematically in side elevation.

DESCRIPTION OF PREFERRED EMBODIMENTS

Figure 3:
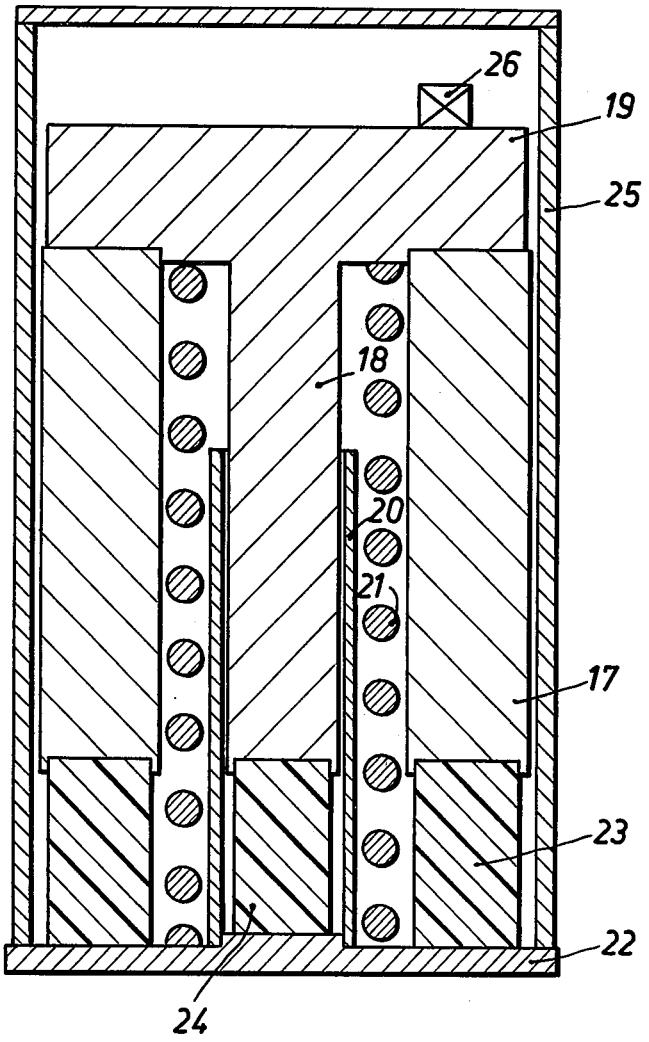
FIG. 3 represents a passive vibration remover shown in axial cross-section.

The arc furnace 1 shown in FIGS. 1 and 2 is closed by a lid 2 in which there are provided three openings 3, 4, 5 for electrodes 6, 7, 8 arranged vertically downwards parallel to each other and on the corner points of an equilateral triangle. Each electrode 6 to 8 is provided with a support arm 9, 10, 11. The support arms 9 to 11 extend parallel to each other. The two outer support arms 10, 11 are of equal length and longer than the middle support arm 9. All support arms 9 to 11 are respectively supported by a stand 12 which is height adjustable. This height adjustability makes it possible for adjusting the gaps between the ends of the electrodes and the level 13 of the bath.

At the exposed ends of each support arms 9 to 11 is connected a vibration remover, 14, 15, 16. The vibration remover is of an axially symmetrical construction. The vibration remover shown in FIG. 3 comprises a radially cylindrical cup 17, a central lug 18, a transverse top part 19 connecting the lug 18 and the cup 17, the parts 17 to 19 forming the so-called "neutral" mass of the vibration remover, a fixed guide sleeve 20 for the lug 18, a helical spring 21 arranged externally of the guide sleeve 20 in the annular gap between the lug 18 and the cup 17 and on the front face a damping body 23, 24 for connecting the cup 17 and the lug 18 to a support 22. The whole unit is encapsulated in a housing 25. The parts forming the neutral mass of the vibration remover (hollow cylindrical cup 17, lug 18, transverse top part 19) and the spring 21 have their natural frequencies tuned to the natural frequency of the vibration system comprising of the support arms 9 to 11 and electrode 6 to 8.

By choosing the damping material for the damping body 23/24 it is possible at high damping values to achieve a somewhat more effective coverage of the band width of the vibration damper.

On the neutral mass 17 to 19 of the vibration remover 14 to 16 or the support arms 9 to 11 there can be provided a vibration pick-up 26, 27 which through a control device can regulate the current supplied to the electrodes 6 to 8 in such a way that on exceeding a pre-determined maximum value, the current supply for one or more phases can be interrupted. This current interruption has the effect of damping the system.

Figure 4:
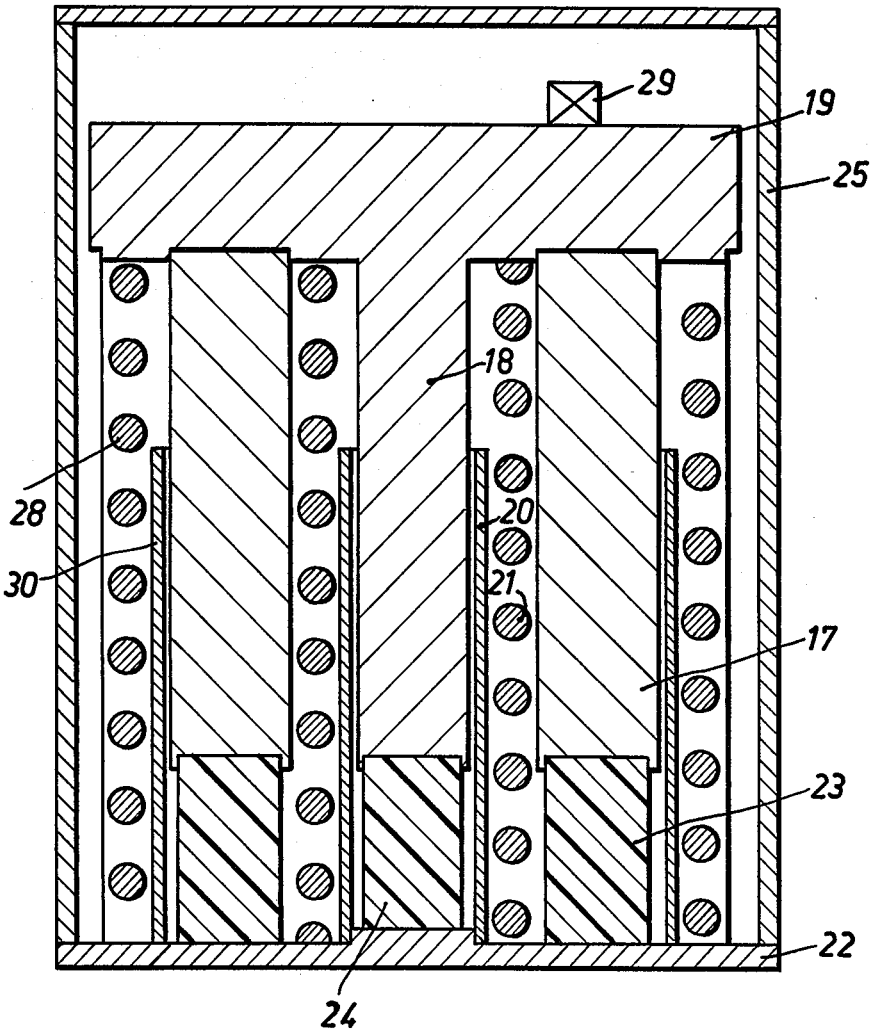
FIG. 4 represents an active vibration remover shown in axial cross-section.

In place of the above described passive vibration remover, it is also possible to provide an active vibration remover or even a combination comprising active and passive vibration removers according to FIG. 4. The basic structure of such a vibration remover corresponds to the passive vibration remover, such as is demonstrated by a comparison of FIG. 3 and 4. The active vibration remover has an electro-magnet the armature of which is formed by at least a part of the neutral mass, in the example the hollow cylindrical part 17. This hollow cylindrical part 17 is surrounded by an electrical winding 28 which is arranged on a fixed guide sleeve 30. The current supplied to this winding 28 is controlled by a control device, not shown. The control device receives a control signal from a vibration pick-up 29 which is arranged on the neutral mass 17 to 19. The triggering thus takes place in response to the vibrations picked up by the vibration pick-up 29 in such a way that the vibration remover is excited to vibrate through the spring 21 and the damping bodies 23, 24 forces are built up on the support arms 9 to 11 which act against the excitation forces of the arc effective on the lower end of the electrodes 6 to 8.

By providing a vibration remover 14 to 16 on a support arm 9 to 11, the resonance peak of the system is suppressed and a curve is obtained which has two amplitude maximum values above and below the resonance frequency or substantially lower absolute values than the system which has not been damped. This means that the vibration stress on the whole system and thus the danger of electrode breakage is reduced.

I claim:

1. An electric arc furnace particularly adapted for melting steel having:

at least one electrode;

a support arm holding said electrode and forming therewith a first oscillating system of a particular system having a particular natural frequency; and a vibration remover comprising a second oscillation system tuned to said particular natural frequency and coupled to said first oscillating system and comprising a neutral mass and a spring;

said first and second oscillation systems being coupled whereby the oscillations of both are of opposite phase and act against each other thereby reducing vibrations of said electrode.

2. The electric arc furnace according to claim 1, wherein said vibration remover is arranged beneath a protective hood.

3. The electric arc furnace according to claim 1, wherein said vibration remover comprises said spring and a damper, said damper being arranged in parallel therewith and said neutral mass, and being supported by said spring and said damper.

4. The electric arc furnace according to claim 1, wherein said spring is a helical spring, and said neutral mass has a lug housed in a fixed sleeve on the outside of which is arranged said spring.

5. The electric arc furnace according to claim 1, wherein said neutral mass is cupshaped and surrounds said spring.

6. The electric arc furnace according to claim 1, wherein said neutral mass is provided with a vibration pick-up, and a control signal transmitter for feeding a switch-off signal to a current supply for one or more phases.

7. The electric arc furnace according to claim 1, wherein said neutral mass of the vibration remover carries a vibration pick-up which, on exceeding a predetermined amplitude value of the vibrations of said neutral mass, delivers a switch-off signal to the current supply of the electrode or electrodes for at least one phase of current.

8. The electric arc furnace according to claim 1, having three electrodes arranged in a triangular relationship held variously by parallel support arms, the outermost support arms being of the same length and the central support arm being of a different length, said vibration remover being arranged on said central support arm.

9. The electric arc furnace according to claim 1, having a plurality of electrodes, said vibration remover being arranged on the support arm of the electrode which is most susceptible to breakage, said mass forming the armature of an electro-magnet, said electromagnet having a winding induced in response to the control signal of a vibration pick-up for the rocking vibrations in such a way that the vibration remover, which has thus been excited to vibrate in the plane of the support arm/electrode, builds up forces in said support arm which act against the excitation forces acting on the lower end of the electrode.

10. The electric arc furnace according to claim 9, wherein said vibration pick-up is arranged on said support arm.

11. The electric arc furnace of claim 9, wherein said vibration pick-up is arranged on said neutral mass.

12. In a method for reducing the breakage rate of electrodes for an electric arc furnace having three triangularly-arranged electrodes held by support arms in parallel with each other, wherein at least one of said support arms is more susceptible to breakage than the others even though the electrode and the support arm which together vibrate as a system having a natural frequency, the improvement comprising:

attaching a vibration remover to said support arm; and tuning the frequency of said vibration remover to the natural frequency of said system for rocking vibration in the plane of said system composed of said support arm and said electrode;

said vibration remover damping said natural vibrations by producing counter forces of the same natural frequency of said system to compensate the forces of the system, thereby reducing the vibration amplitude.

13. In the method as claimed in claim 12, including providing two of said support arms of the same length and the third of said support arms of a different length, and arranging said vibration absorber on said third support arm.

14. In the method as claimed in claim 12, including connecting all three of said arms to a stand positioned adjacent to said furnace, and positioning said third arm between said other two arms.

15. In the method as claimed in claim 12, including providing a vibration pick-up on said support arms, and regulating the current supplied to said electrodes such that on exceeding a predetermined value, the current supply for one or more phases can be interrupted, said current interruption being effective to damp the system.

16. In the method as claimed in claim 12, including providing an electro-magnetic system comprised of an armature and coil in which a part of the neutral mass of said vibration remover forms the armature, arranging the coil on a fixed guide sleeve surrounding said neutral mass, and exciting said electro-magnetic system to vibrate said vibration remover.

17. In the method as claimed in claim 16, including providing a vibration pick-up on said support arms, and regulating he current supplied to said electrodes such that on exceeding a predetermined value, the electro-magnetic system is excited, and the current supply for one or more phases can be interrupted, said current interruption being effective to damp the system.

* * * * *